United States Patent [19]

Van Orsdel et al.

[11] 3,942,447

[45] Mar. 9, 1976

[54] FUZING SYSTEM

[75] Inventors: Kenneth A. Van Orsdel, Corona; John O. Dick, Riverside, both of Calif.

[73] Assignee: The United States of America as represented by the Secretary of the Navy, Washington, D.C.

[22] Filed: Apr. 18, 1967

[21] Appl. No.: 635,297

[52] U.S. Cl. ..... 102/70.2 P; 250/338; 244/3.17

[51] Int. Cl.[2] ..... F42B 5/08

[58] Field of Search ..... 250/338, 203 R; 102/70.2 P; 244/3.17

[56] References Cited

UNITED STATES PATENTS 3,061,727 10/1962 Roth et al. ..... 250/338

*Primary Examiner*—Maynard R. Wilbur
*Assistant Examiner*—S. C. Buczinski
*Attorney, Agent, or Firm*—Richard S. Sciascia; Joseph M. St. Amand; T. M. Phillips

[57] ABSTRACT

A fuzing system in which a third or obscuration channel having a forward looking narrow beam width detects a target and generates a signal which is fed to a sequence computer. If within a predetermined time after receipt of the third channel pulse, a second pulse is received from either of the two regular infrared channels, a pulse is generated to actuate the firing circuit. If the above time sequence of pulses is not present, the fuze system then functions in the normal two channel mode of operation.

7 Claims, 3 Drawing Figures

TIME SEQUENCE OF INTERCEPT
FROM TIME OBSCURATION
CHANNEL FIRST SEES TARGET

KENNETH A. VAN ORSDEL
JOHN O. DICK
INVENTORS

BY T. M. Phillips
J. M. St. Amand
ATTORNEYS

KENNETH A. VAN ORSDEL
JOHN O. DICK
INVENTORS

BY R. M. Phillips
J. M. St. Amand
ATTORNEYS

FUZING SYSTEM

The invention herein described may be manufactured and used by or for the Government of the United States of America for governmental purposes without the payment of any royalties thereon or therefor.

BACKGROUND OF THE INVENTION

The present invention relates to fuzing systems and more particularly to optical fuzing systems wherein the target is detected by a first detecting channel and if the target is detected by a second detecting channel within a predetermined time interval, a firing signal is generated. This system functions with a very high probability of target kills when the missile is overtaking the target from the rear hemisphere. When the missile is approaching the target from other than the rear, the missile may have passed the target before the second channel detector sees the target and the result is the warhead explodes too late to damage the target.

SUMMARY

The present invention provides a fuzing system which overcomes the deficiencies of the prior known two channel infrared systems by providing a third channel with a silicon diode detector and having a narrow conical detecting beam which looks sufficiently forward of the missile that a signal generated by the detection of a target will produce an arming gate so that if subsequently either of the two channels detects a target within the duration of the arming gate, a firing pulse will be generated. If no target is detected by either of the two infrared channels within the duration of the arming gate, the fuzing system will return to normal two channel operation.

Many of the attendant advantages of this invention will become readily appreciated as the same becomes better understood by reference to the following detailed description when considered in connection with the accompanying drawings wherein.

Figure 1:
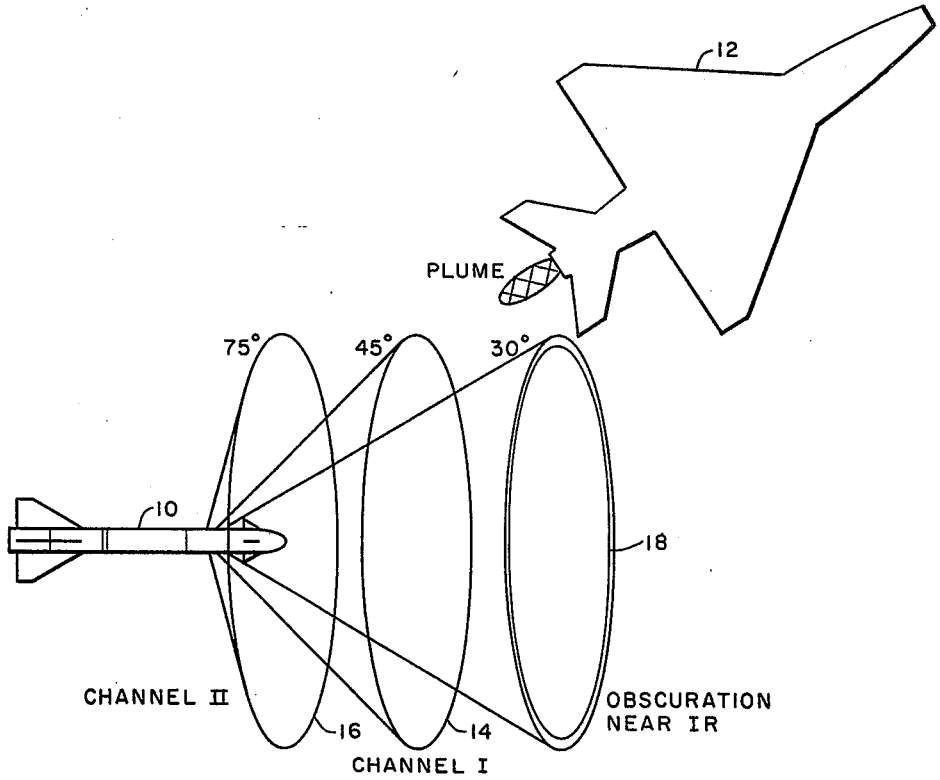
FIG. 1 is a diagram showing the detection beams relative to a target.
Figure 3:
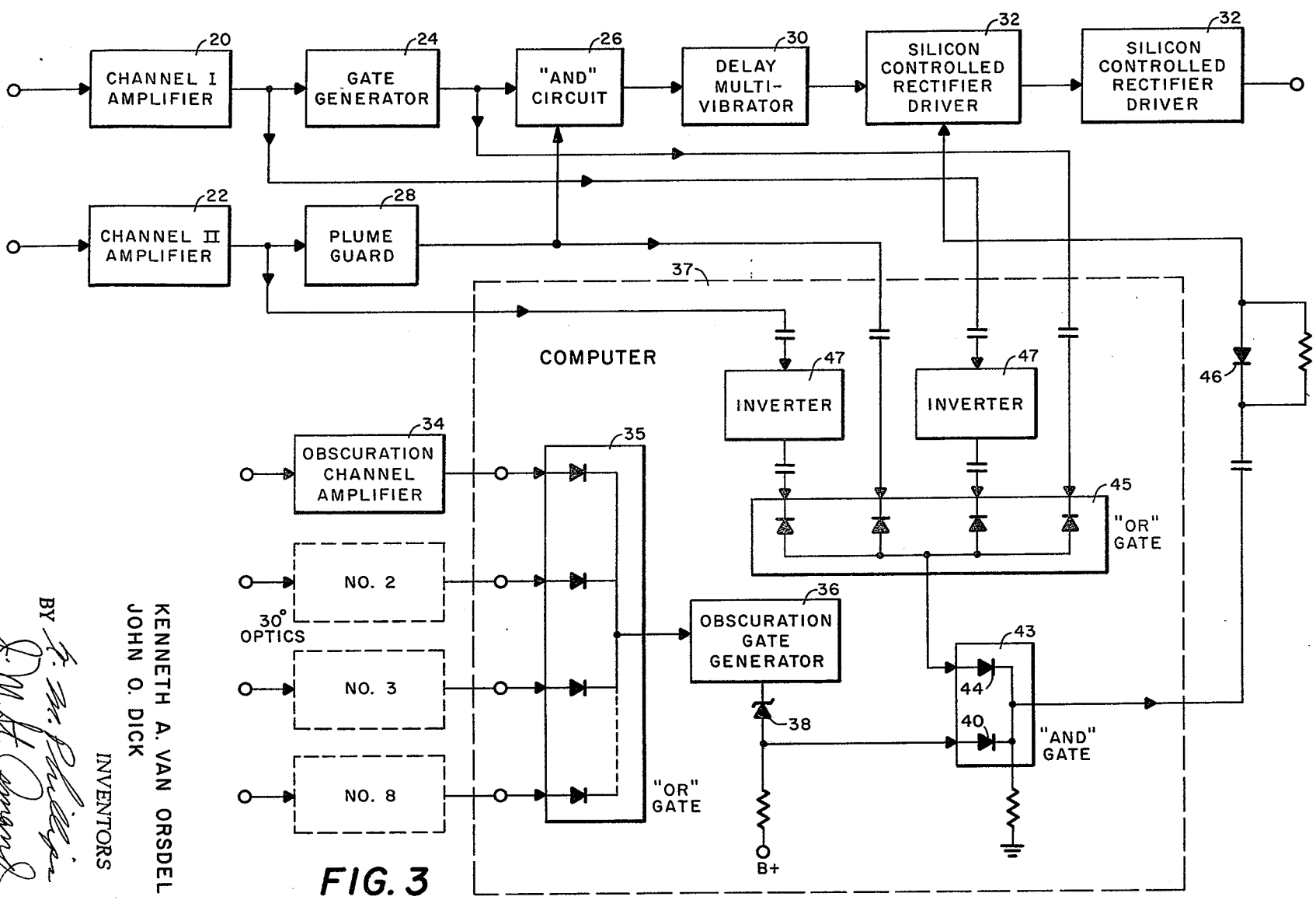
FIG. 3 is a block diagram of a preferred embodiment of the invention.

Referring now to the drawings there is shown in FIGS. 1 and 3 a missile 10 launched against a target 12. Mounted in missile 10 are two infrared detectors and associated optical assemblies having fields of view represented by hollow cones 14 and 16 and an obscuration sensing silicon detector optical assembly having a field of view represented by segmented hollow cone 18. Maximum range of the system is restricted to ranges at which anticipated targets will produce obscuration of a portion of the very restricted field of view of the optics of the system. The total hollow cone 18 is divided into eight segments of view. Each segment contains a complete optical field of view with associated detectors and amplifiers as shown in FIG. 3. In a typical fuzing situation and assuming the diameter of missile 10 is 6 inches, the range from target 12 is 17 feet maximum (should coincide with effective range of the warhead used), and a beam width of 2°, a cone segment then will be an arc of 16 feet by 5 inches thickness. An obscuration or interruption of any portion of this arc will generate a signal. Glent caused by the sun, reflecting light from target 12, reflecting clouds or any condition resulting in an increase of ambient light will produce a higher level of detector bias. This increase in the level of detector bias is of the opposite polarity to the desired obscuration signals and will not be amplified. Glent signals will occur only momentarily within the obscuration period and will not negate the satisfactory operation of the system. Signals generated by energy received in fields of view 14 and 16 are fed to channel I and channel II amplifiers 20 and 22 respectively. The output of amplifier 20 is fed to and triggers gate generator 24 whose output is coupled to "and" circuit 26 while the output of amplifier 22 is fed through plume guard circuit 28 to "and" circuit 26. Plume guard circuit 28 is of the type shown and described in my copending applications Ser. No. 380,957, filed July 7, 1964, for Fuze Signal Processing Circuit and Ser. No. 540,145, filed Mar. 30, 1966, for Two Channel Optical Fuzing System. If signals are received by "and" circuit 26 in the proper time relationship, a signal is fed to delay multivibrator 30 which produces an output pulse for initiating firing pulse generator 32 which may be a silicon controlled rectifier (SCR) driver driving a silicon controlled rectifier.

Figure 2:
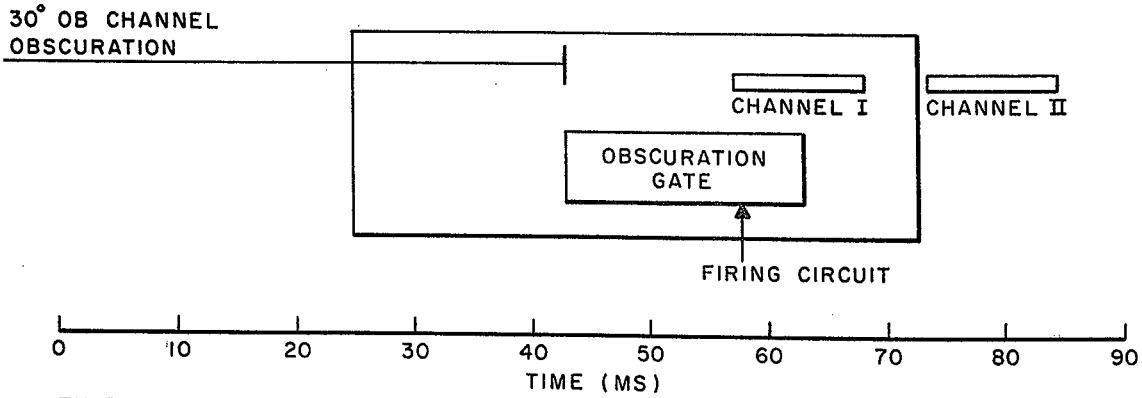
FIG. 2 is a graph showing the time sequence of the intercept of a target.

The output signal from the obscuration detector when its field of view 18 (FIG. 2) is obscured by the target 12 is fed to amplifier 34 (FIG. 3). The amplified output signal of amplifier 34 is fed through "or" gate 35 to gate generator 36 which may be of the type shown and described in patent application Ser. No. 540,145 filed Mar. 30, 1966, for Two Channel Optical Fuzing System and generates a gate pulse that is fed to Zener diode 38. The gate signal passed by Zener diode 38 is fed to diode 40 of "and" gate 43. The leading and trailing edges of channel I and channel II signals are coupled to "or" gate 45. The output signal from "or" gate 45 is fed to diode 44 of "and" gate 43. Inverters 47 and 49 are utilized to provide proper signal polarity to "or" gate 45. When a signal is present at diode 44 during the presence of a gate signal at diode 40, a negative output signal is coupled through diode 46 to firing circuit 32.

In operation, channels I and II may be the normal infrared detecting channels. Channel III should be operating in the near infrared portion of the spectral band from approximately 0.5 to 1.1 microns. The detectors for channel III should be of the silicon diode type and operating near saturation due to ambient sky light or from reflected light from surrounding terrain. The optical units in all three channels should have a limited field of view so that optical assembly in each channel sees a narrow cone beam around the missile axis with a beam width of from 2° to 4°. In practice, channel III consists of eight separate detectors positioned around the missile axis with ambient light sensing restricted to thirty degrees or less around the axis. As the missile 10 intercepts a target aircraft or missile 12, the target obscures the light from one of the eight optical units of channel III and an output signal is produced. If the intercept is from the rear hemisphere, the obscuration signal persists beyond the time duration pre-selected for firing since no signal is received from either channels I or II.

If the intercept is such that one or more of detectors is obscured which results in an output signal, this signal is fed by "or" gate 35 to obscuration gate generator 36 where it is differentiated and the trailing edge of the differentiated signal actuates the gate. The intercept geometry (FIG. 1) is such that by the termination of the gate signal, missile 10 is in a position in relation to target 12 that forward looking channel 18 is now looking past the target. Channels 14 and 16 are now in or approaching a position that the target 12 jet engine and plume can be sensed by their infrared detectors.

The output of gate generator 36 is fed into computer 37 in addition to the leading and trailing edge pulses of channels I and II. With diode 40 biased by the gate pulse from gate generator 36, the first signal from any of the four remaining inputs will cause conduction by diode 46 and the silicon controlled rectifier driver of firing circuit 32 will cause a firing pulse to be generated.

Obviously many modifications and variations of the present invention are possible in the light of the above teachings. It is therefore to be understood that within the scope of the appended claims the invention may be practiced otherwise than as specifically described.

What is claimed is:

1. In an optical fuzing system for guided missiles the combination comprising:

a. a first infrared energy detecting channel for detecting an infrared energy radiating target, b. a second infrared energy detecting channel for detecting said infrared energy radiating target, c. a gate pulse generator coupled to said first infrared energy detecting channel for generating a pulse of a predetermined width after receipt of a signal from said first channel, d. an "and" circuit coupled to said gate pulse generator and to said second infrared energy detecting channel for generating an output pulse when a signal is received from said second channel during the time interval of the pulse received from said gate pulse generator, e. fuze firing pulse generating means coupled to said "and" circuit for generating a firing pulse in response to an output pulse generated by said "and" circuit, f. a third detecting channel being responsive to the obscuration of skylight by said target for generating an output signal, g. computer circuit means coupled to said first, second, and third detecting channels and to said fuze firing pulse generating means and being responsive to an output signal from said third channel to pass the first output signal received from either of said first and second channels to trigger said fuze firing pulse generator to generate a firing pulse.

2. In an optical fuzing system for guided missiles, the combination comprising:

a. a first infrared energy detecting channel for detecting an infrared energy radiating target, b. a second infrared energy detecting channel for detecting said infrared energy radiating target, c. a gate circuit coupled to said first and second infrared energy detecting channels for generating a pulse after receipt of a first signal from said first channel and a second pulse from said second channel within a predetermined time interval following receipt of the first signal, d. fuze firing pulse generating means coupled to said gate circuit for generating a firing pulse in response to an output pulse from said gate circuit, e. a third detecting channel being responsive to the obscuration of skylight by said target for generating an output signal, f. computer circuit means coupled to said first, second, and third detecting channels and to said fuze firing pulse generating means and being responsive to an output signal from said third channel to pass the first output signal received from either of said first and second channels to trigger said fuze firing pulse generator to generate a firing pulse.

3. The optical fuzing system of claim 2 wherein said a. first channel has a forward looking angle of 45°, b. second channel has a forward looking angle of 75°, c. third channel has a forward looking angle of 30°.

4. In a three channel, optical passive fuzing system, using three optical channels to detect a target and to compute the optimum time to fire to produce maximum kill probability, the combination comprising:

a. a first infrared energy detecting channel for detecting an infrared energy radiating target, b. a second infrared energy detecting channel for detecting said infrared energy radiating target, c. a third detecting channel being responsive to the obscuration of skylight by said target for generating an output signal, d. a gate pulse generator coupled to said first infrared energy detecting channel for generating a pulse of a predetermined width after receipt of a signal from said first channel, e. a decision circuit coupled to said first, second and third channel for generating an output pulse in response to the first signal received from either of said first or second channels within a predetermined time interval after a signal has been received from said third channel, f. a firing pulse generator coupled to said first and second channels and to said decision circuit and being responsive to the output signal from said decision circuit for generating a firing pulse.

5. In a three channel, optical passive fuzing system, using three optical channels to detect a target and to compute the optimum time to fire to produce maximum kill probability, the combination comprising:

a. a first channel having a forward looking angle of 45° and being responsive to infrared energy radiated by a target of interest to generate an output signal, b. a second channel having a forward looking angle of 75° and being responsive to infrared energy radiated by said target of interest to generate an output signal, c. a third channel having a forward looking angle of 30° and including a detector operating near saturation due to ambient skylight and producing an output signal when the ambient skylight is obscured by said target of interest, d. a decision circuit coupled to said first, second and third channels for generating an output pulse in response to the first signal received from either of said first or second channels within a predetermined time interval after a signal has been received from said third channel, e. a firing pulse generator coupled to said first and second channels and to said decision circuit and being responsive to the output signal from said decision circuit for generating a firing pulse.

6. The fuzing system of claim 4 wherein said decision circuit is responsive to the leading edge of the first signal received from either of said first or second channels within a predetermined time interval after a signal has been received from said third channel.

7. The fuzing system of claim 4 wherein said decision circuit is responsive to the trailing edge of the first signal received from either of said first or second channels within a predetermined time interval after a signal has been received from said third channel.

* * * * *